US011541409B2

(12) United States Patent
Petkus et al.

(10) Patent No.: US 11,541,409 B2
(45) Date of Patent: Jan. 3, 2023

(54) APPARATUS AND METHOD FOR PROVIDING AN IMPROVED SPRAY PATTERN WITH A SQUEEZE BOTTLE

(71) Applicant: S. C. Johnson & Son, Inc., Racine, WI (US)

(72) Inventors: Matthew Michael Petkus, Lake Villa, IL (US); Ronald H. Spang, Jr., Kenosha, WI (US); Mark J Van Handel, Greendale, WI (US); Bradley J. Barron, Los Angeles, CA (US)

(73) Assignee: S. C. Johnson & Son, Inc., Racine, WI (US)

( * ) Notice: Subject to any disclaimer, the term of this patent is extended or adjusted under 35 U.S.C. 154(b) by 516 days.

(21) Appl. No.: 14/958,120

(22) Filed: Dec. 3, 2015

(65) Prior Publication Data

US 2016/0158775 A1 Jun. 9, 2016

Related U.S. Application Data

(60) Provisional application No. 62/087,701, filed on Dec. 4, 2014.

(51) Int. Cl.

| | |
|---|---|
| ***B05B 11/04*** | (2006.01) |
| ***B05B 11/00*** | (2006.01) |
| ***B05B 1/12*** | (2006.01) |
| ***B05B 1/16*** | (2006.01) |
| ***B05B 7/00*** | (2006.01) |
| *B05B 15/33* | (2018.01) |

(Continued)

(52) U.S. Cl.

CPC ..... *B05B 11/0029* (2013.01); *B05B 1/12* (2013.01); *B05B 1/16* (2013.01); *B05B 7/0037* (2013.01); *B05B 11/0037* (2013.01); *B05B 11/047* (2013.01); *B05B 1/3436* (2013.01); *B05B 11/0008* (2013.01); *B05B 15/30* (2018.02); *B05B 15/33* (2018.02)

(58) Field of Classification Search

CPC ..... B05B 11/0032; B05B 1/12; B05B 1/16; B05B 11/047; B05B 7/0037; B05B 11/0029; B05B 11/0037

USPC ..... 239/1

See application file for complete search history.

(56) References Cited

U.S. PATENT DOCUMENTS 2,311,845 A * 2/1943 Lindsay ..... A62C 99/0027 169/72
3,210,820 A * 10/1965 Humiston ..... A44B 17/0029 24/578.12

(Continued)

FOREIGN PATENT DOCUMENTS

CN 102413942 A 4/2012
JP S62 60555 U 4/1987

(Continued)

OTHER PUBLICATIONS

PCT/US2015/063742 International Search Report and Written Opinion dated Feb. 10, 2016.

(Continued)

*Primary Examiner* — Chee-Chong Lee
(74) *Attorney, Agent, or Firm* — Quarles & Brady LLP

(57) ABSTRACT

A spray nozzle assembly includes a rotating spray nozzle and a cap for attachment to a squeeze bottle. The spray nozzle includes at least one exit orifice and at least three sidewall portions. The cap includes an indicator on an upper surface.

9 Claims, 7 Drawing Sheets

(51) Int. Cl.
*B05B 15/30* (2018.01)
*B05B 1/34* (2006.01)

(56) References Cited

U.S. PATENT DOCUMENTS 4,161,288 A * 7/1979 McKinney ..... B05B 1/12 222/380
4,247,048 A * 1/1981 Hayes ..... B05B 1/12 222/553
4,463,905 A * 8/1984 Stoesser ..... A47K 5/14 239/329
4,598,862 A * 7/1986 Rice ..... B05B 7/005 239/311
4,666,085 A * 5/1987 Liaw ..... B05B 1/1654 239/394
4,669,665 A * 6/1987 Shay ..... B05B 7/0056 239/403
5,303,851 A * 4/1994 Libit ..... B05B 11/303 222/207
5,638,994 A * 6/1997 Libit ..... B05B 11/3032 222/207
6,382,527 B1 5/2002 Dukes et al.
2010/0237159 A1 9/2010 Prater et al.
2013/0104939 A1 5/2013 Shibata et al.

FOREIGN PATENT DOCUMENTS

JP H02102366 U 8/1990
JP H08 252508 A 10/1996

OTHER PUBLICATIONS

China National Intellectual Property Administration, Notice of First Office Action, dated Sep. 19, 2018, 13 pages.
Second Office Action issued in corresponding Chinese Application No. 201580074114.3, dated May 29, 2019, 2019, 13 pages.
Communication pursuant to Article 94(3) EPC for corresponding European Patent Application No. 15813211.8, dated Aug. 12, 2022.

* cited by examiner

APPARATUS AND METHOD FOR PROVIDING AN IMPROVED SPRAY PATTERN WITH A SQUEEZE BOTTLE

CROSS REFERENCE TO RELATED APPLICATIONS

This application claims the benefit of U.S. Provisional Application No. 62/087,701, which was filed on Dec. 4, 2014.

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present disclosure relates generally to spray nozzle assemblies for squeeze bottles and, more particularly, to spray nozzle assemblies capable of producing different liquid output patterns for use with squeeze bottles.

2. Description of the Background of the Invention

Liquid dispensers can take on various general forms, e.g., squeeze bottles, trigger sprayers, finger type pumps, aerosol dispensers, etc. Typically, trigger sprayers are fitted with nozzle assemblies that can project different liquid output patterns, e.g., a stream, aerated foam, a spray, i.e., a divergent or conical spray pattern, and the like. The design of such nozzle assemblies generally depends on the intended application and/or the characteristics of the liquid that is dispensed.

For example, if the liquid is intended to be suspended in the air, a nozzle assembly to project a divergent spray may be used, but if the liquid is intended to be applied to a surface, e.g., carpet, wood, a painted surface, etc., a nozzle assembly to project a stream or foam may be used. Further, the nozzle assembly can include multiple settings such as spray, stream, foam, and/or an off setting. A common drawback to these prior art trigger sprayers is that they can only produce non-continuous sprays, or discrete sprays comprising a small volumetric output, with each pump of the trigger.

Further, many prior art squeeze bottles that allow for a continuous spray only dispense liquid in a single solid stream pattern. The liquid is dispensed through an exit orifice, or multiple exit orifices, when a user applies a pressure to the walls of the bottle. A common drawback to these prior art squeeze bottle liquid dispensers is that there is no ability to adjust the liquid output pattern or to provide an output pattern with a non-stream pattern.

Therefore, there is a need for squeeze bottle liquid dispensers that produce a spray pattern similar to that of a trigger sprayer with a nozzle assembly. The present disclosure provides for such a squeeze bottle with a nozzle assembly that allows for the desired spray pattern to be dispensed with a continuous flow. The present disclosure also provides a more cost effective sprayer that provides a user the desired spray pattern that is normally produced from a trigger sprayer without the trigger, therefore using less material.

SUMMARY OF THE INVENTION

According to a first aspect, a spray nozzle assembly includes a rotating spray nozzle and a cap for attachment to a squeeze bottle. The spray nozzle comprises at least one exit orifice and at least three sidewall portions. The cap includes an indicator on an upper surface.

According to another aspect, a spray nozzle assembly includes a spray nozzle and a cap attached to a squeeze bottle. The spray nozzle includes a first operational state and a second operational state for the emission of fluid.

In still another aspect, a method of providing a sprayer to a consumer includes the step of providing a spray nozzle assembly including a rotating spray nozzle and a cap for attachment to a squeeze bottle. Another step includes the provision of instructions, which instruct a user to rotate the spray nozzle until either a first sidewall portion with a first spray pattern or a second sidewall portion with a second spray pattern is adjacent to an indicator on the cap, orient the squeeze bottle to either a first position directed at a first intended surface to be sprayed or a second position directed at a second intended surface to be sprayed, and apply pressure to the squeeze bottle to emit a fluid.

DETAILED DESCRIPTION OF THE DRAWINGS

Figure 1:
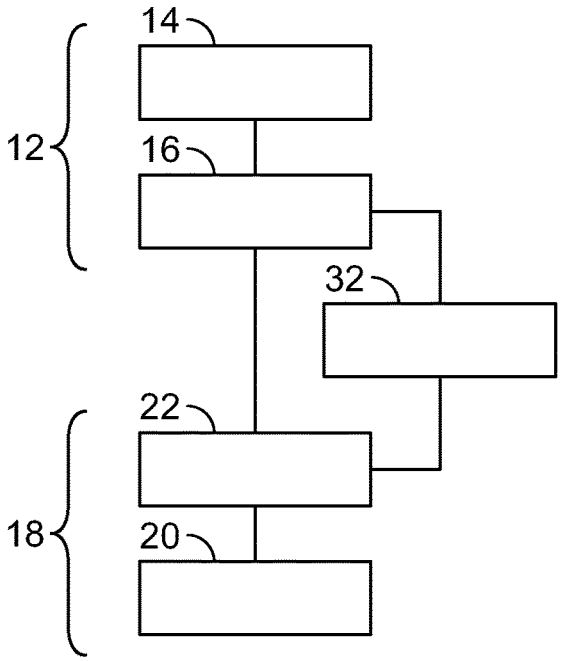
FIG. 1 is a schematic diagram of a spray nozzle assembly.

Referring to FIG. 1, a schematic representation of a spray nozzle assembly 12 is depicted, which is designed to be utilized with any of the methodologies described herein. The spray nozzle assembly 12 generally includes a spray nozzle 14 comprising an insert or mechanical break-up unit and a cap 16. A container 18 is adapted to receive the spray nozzle assembly 12. The container 18 is a squeeze bottle that contains a liquid 20 provided within a reservoir 22. The liquid 20 may be a fragrance, insecticide, a deodorizer, a fungicide, a bacteriocide, a cleaner, an all purpose cleaner, or a floor cleaner. The liquid 20 may also include one or more surfactants. The liquid 20 may further be a sanitizer, a pet barrier, or other active volatile or other compound disposed within a carrier liquid (for example, an oil-based and/or water-based carrier), a deodorizing liquid, or the like. For example, the liquid may comprise PLEDGE®, a surface cleaning active, WINDEX®, a glass cleaner, RAID®, a pest control active, OUST®, an air and carpet sanitizer, or GLADE®, a deodorant, all sold by S. C. Johnson and Son, Inc., of Racine, Wis., for household, commercial, and institutional use. The liquid may also comprise other actives, such as sanitizers, air and/or fabric fresheners, cleaners, odor eliminators, mold or mildew inhibitors, insect repellents, and the like, or others that have aromatherapeutic properties. The liquid alternatively comprises any fluid known to those skilled in the art that can be dispensed from a container.

The container 18 is preferably fashioned from a material that is resiliently deformable and that maintains its shape upon release by a user's hand. In one embodiment, the container 18 comprises a non-interrupted curved sidewall with two generally parallel spaced diaphragmatic surfaces, e.g., a front wall 24 and a rear wall (not shown), and two opposing sidewalls 26*a*, 26*b*. These diaphragmatic surfaces are, in one particular embodiment, sized in a ratio of from about 1:4 to about 1:3 in relation to the sidewalls 26*a*, 26*b*. The diaphragmatic surfaces are connected to the sidewalls 26*a*, 26*b* by curved portions that are free of sharp corners to promote easy flexing. The container 18 further includes a neck finish 28, a lower end 30*a* or rounded base, and an upper end 30*b* or rounded shoulder. The container 18 may be formed from a flexible material such as high-density polyethylene (HDPE), polypropylene (PP), or polyethylene terephthalate (PET) and may have a wall thickness of about 0.018 inches or a wall thickness from about 0.008 inches to about 0.018 inches or about 0.018 inches to about 0.024 inches.

In one embodiment, the container 18 has a height of about 8 inches, or about 9 inches, or about 10 inches, or a height ranging from about 6 inches to about 8 inches, or about 8 inches to about 10 inches, or about 10 inches to about 12 inches. The container 18 also has a width between opposing sidewalls 26*a*, 26*b* of about 3 inches, or about 4 inches, or about 5 inches, or a width ranging from about 2 inches to about 4 inches, or about 4 inches to about 6 inches. The container 18 further has a shoulder depth between the front wall 24 and the rear wall (not shown) at the shoulder 30*b* and a base depth between the front wall 24 and the rear wall (not shown) at the base 30*a*. The container 18 has a shoulder depth of about 1.9 inches, or about 2.0 inches, or about 2.1 inches, or a shoulder depth ranging from about 1.5 inches to about 1.8 inches, or about 1.8 inches to about 2.2 inches, or about 2.2 inches to about 2.5 inches. The container 18 further has a base depth of about 2 inches, or about 2.5 inches, or about 3 inches, or a base depth ranging from about 1 inch to about 2 inches, or about 2 inches to about 3 inches, or about 3 inches to about 4 inches.

In one embodiment, the neck finish 28 of the container 18 includes threading and threadably engages the cap 16. The neck finish 28 has a height of about 0.5 inches, or about 0.6 inches, or about 0.7 inches, or a height ranging from about 0.3 inches to about 0.5 inches, or about 0.5 inches to about 0.7 inches, or about 0.7 inches to about 0.9 inches. The neck finish 28 further has an outermost diameter of about 0.7 inches, or about 0.8 inches, or about 0.9 inches, or a diameter ranging from about 0.6 inches to about 0.8 inches, or about 0.8 inches to about 1.0 inches, or about 1.0 inches to about 1.2 inches.

In one embodiment, the diaphragmatic surfaces have a height of about 6.0 inches, or about 6.2 inches, or about 6.4 inches, or a height ranging from about 5 inches to about 6 inches, or about 6 inches to about 7 inches, or about 7 inches to about 8 inches. The diaphragmatic surfaces further have a width of about 3.0 inches, or about 3.5 inches, or about 4.0 inches, or a width ranging from about 2.5 inches to about 3.5 inches, or about 3.5 inches to about 4.5 inches. The diaphragmatic surfaces further have a surface area of about 21.3 inches squared, or about 21.5 inches squared, or a surface area ranging from about 16 inches squared to about 21 inches squared, or about 21 inches squared to about 26 inches squared.

Figure 2:
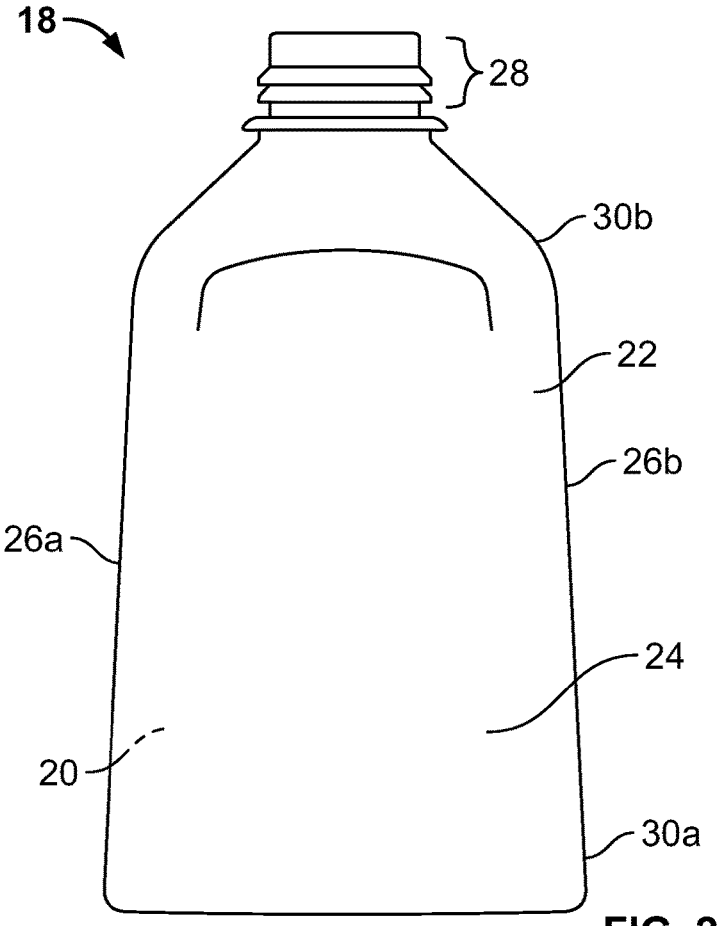
FIG. 2 is a front elevational view of a squeeze bottle.
Figure 2A:
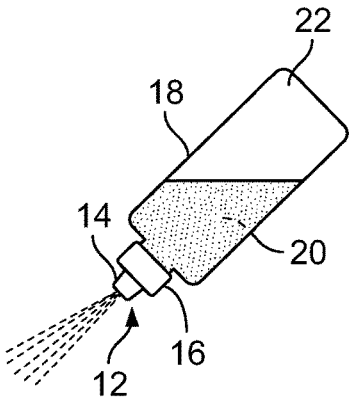
FIG. 2A is a schematic view of an embodiment of a spray nozzle assembly on a squeeze bottle with no dip tube.
Figure 2B:
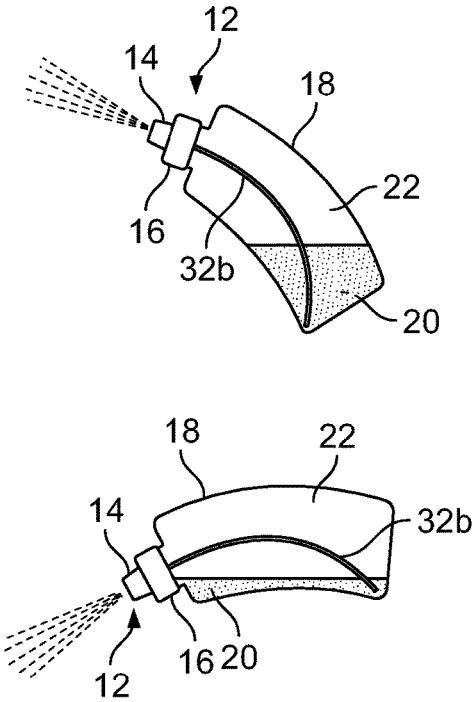
FIG. 2B is a schematic view of another embodiment of a spray nozzle assembly on a squeeze bottle with a rigid dip tube.
Figure 2C:
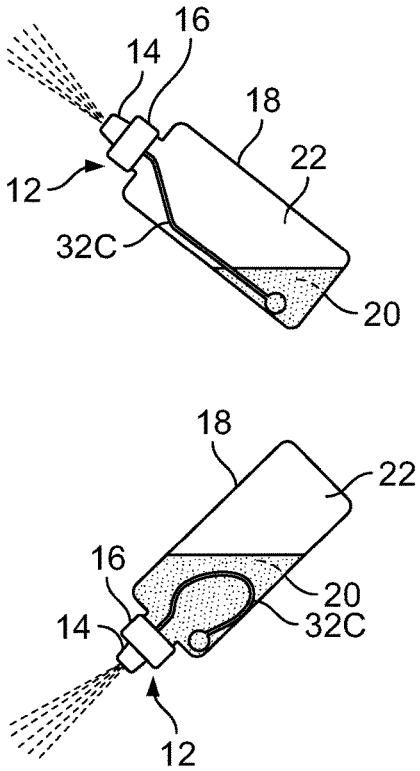
FIG. 2C is a schematic view of yet another embodiment of a spray nozzle on a squeeze bottle with a flexible dip tube.
Figure 2D:
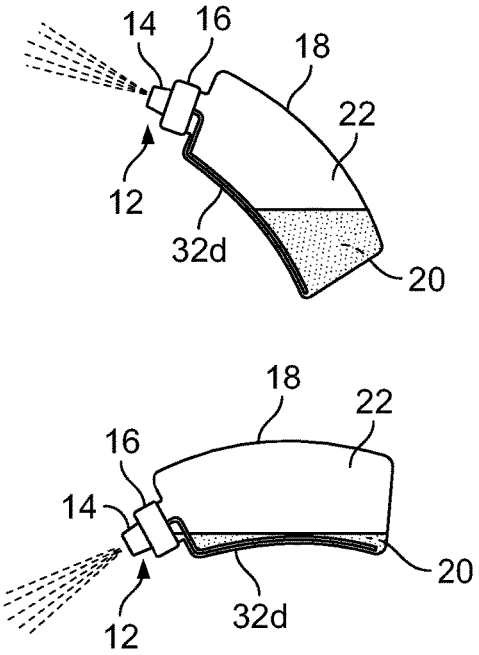
FIG. 2D is a schematic view of a different embodiment of a spray nozzle on a squeeze bottle with an in-molded dip tube.

In one embodiment, the liquid 20 exits the reservoir 22 of the container 18 and directly enters the cap 16 to then be dispensed through the spray nozzle 14, such as seen in FIG. 2A. In another embodiment, the liquid 20 exits the reservoir 22 of the container 18 through a dip tube 32 (see FIG. 1), such as depicted in the exemplary embodiments of FIGS. 2B-2D. It is anticipated that there could be multiple types of dip tubes 32 used with the spray nozzle assembly 12. In one embodiment, a substantially rigid dip tube 32*b* is provided to transmit the liquid 20 from the bottom of the reservoir 22 to the spray nozzle assembly 12 (see FIG. 2B). In the present embodiment, the dip tube 32*b* is shown as curved; however, other geometries are also contemplated, e.g., a straight dip tube. In another embodiment shown in FIG. 2C, the spray nozzle assembly 12 is paired with a dip tube 32*c* that is flexible and weighted such that it naturally falls to the position of the liquid 20 when the container 18 is in any orientation. In yet another embodiment, the container 18 used with the spray nozzle assembly 12 includes a molded-in dip tube 32*d* designed to draw fluid to the spray nozzle assembly 12 in many bottle orientations, such as shown in FIG. 2D. The spray nozzle assembly 12 is generally described including the aforementioned components, but the spray nozzle assembly 12 may be adapted to add or remove various components according to specific embodiments.

Figure 3:
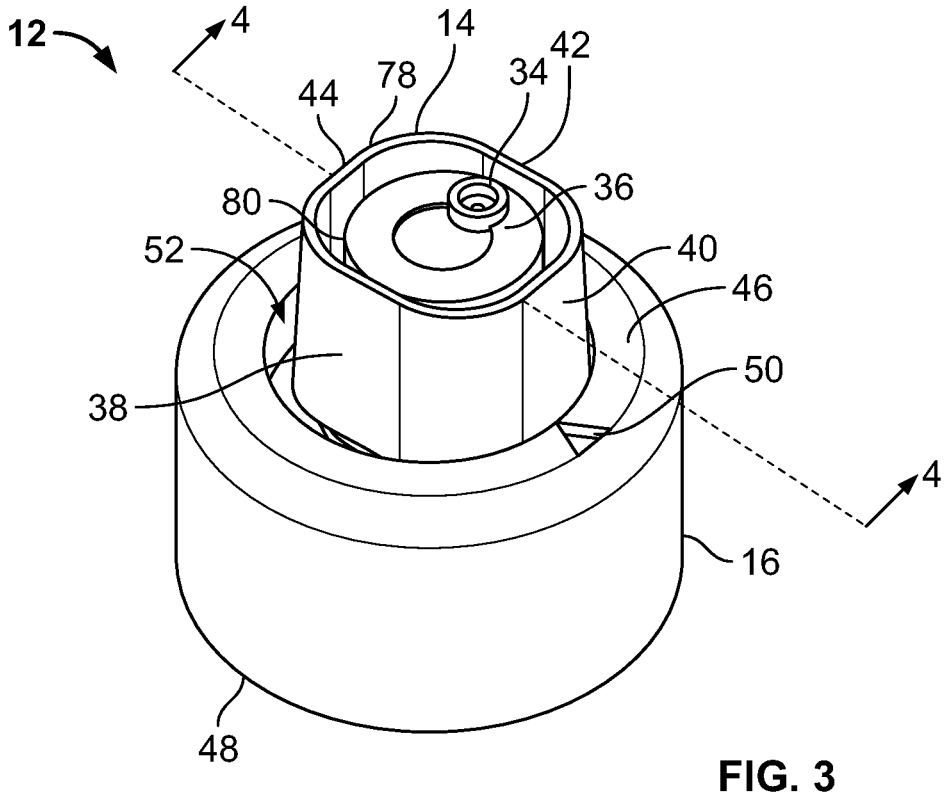
FIG. 3 is an isometric view of a spray nozzle assembly according to one embodiment.
Figure 4A:
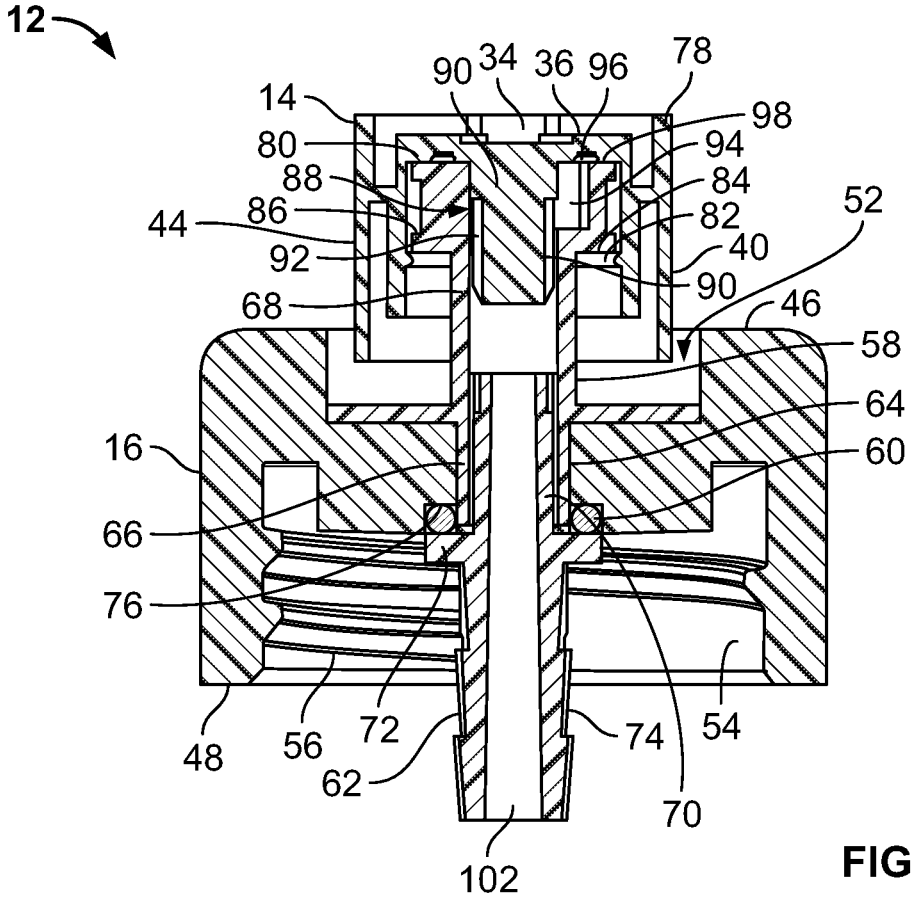
FIG. 4A is a cross-sectional view of the spray insert taken generally along the lines 4-4 of FIG. 3.
Figure 4B:
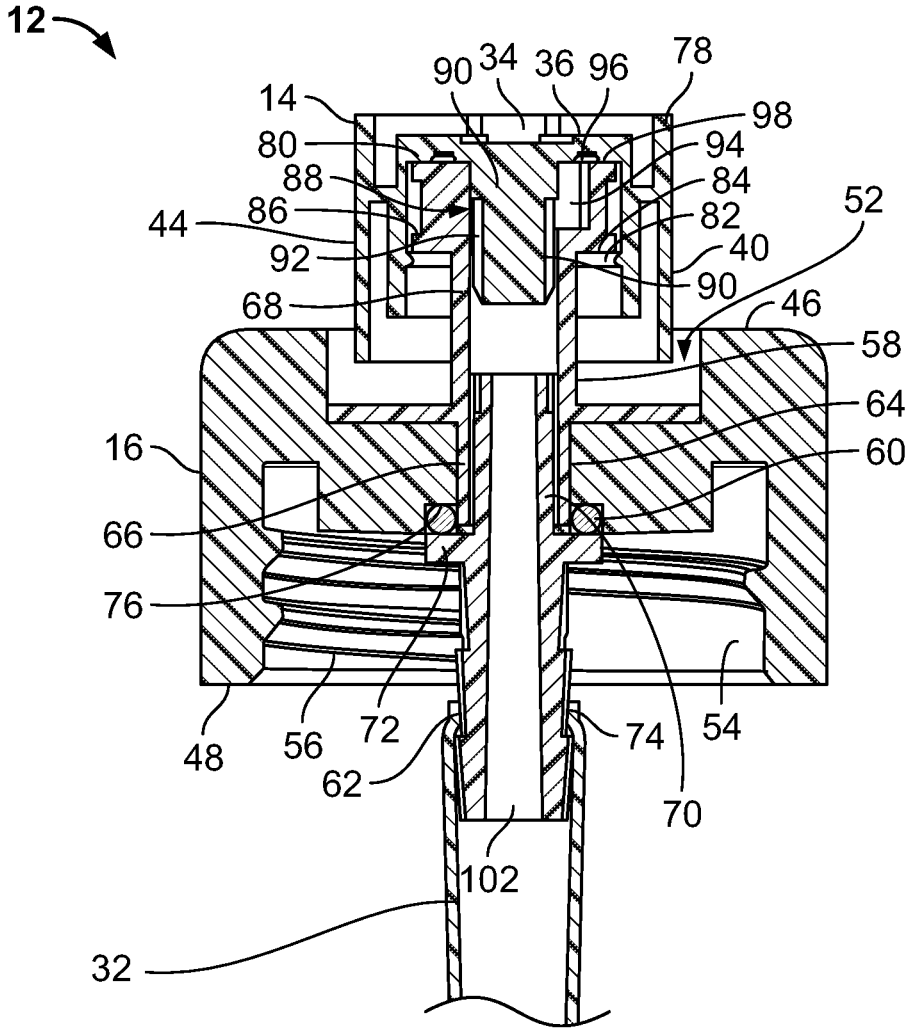
FIG. 4B is a cross-sectional view of the spray insert taken generally along the lines 4-4 of FIG. 3, wherein a dip tube is positioned around a bottom end of the spray insert.
Figure 5:
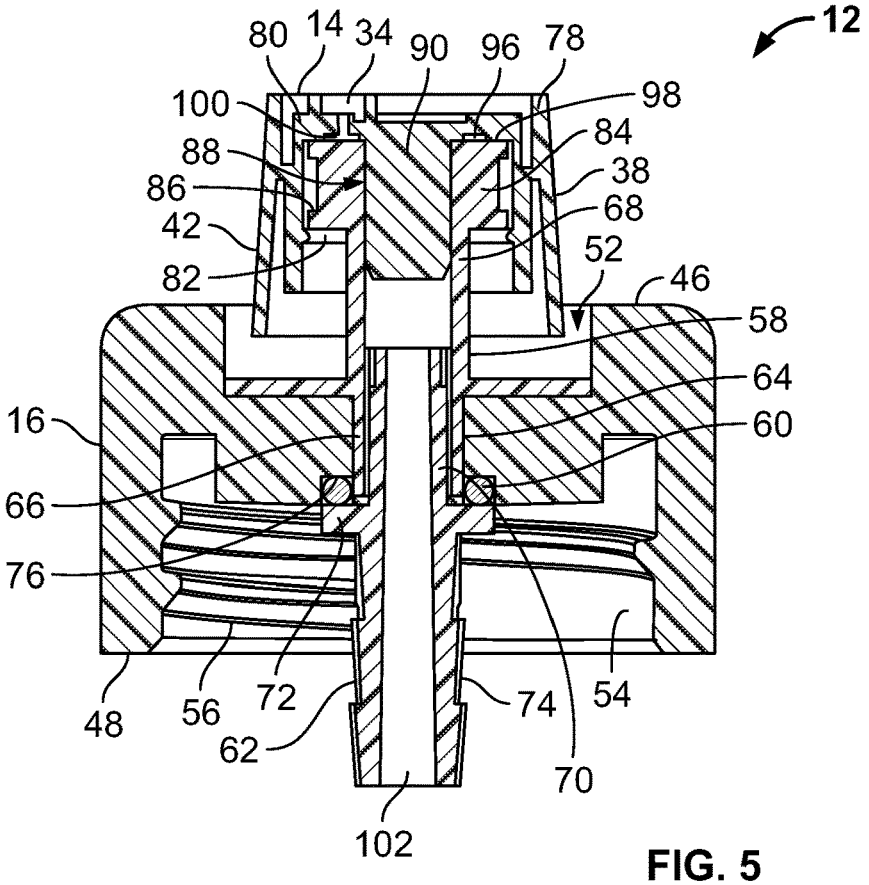
FIG. 5 is a cross-sectional view of the spray insert of FIG. 4A in an alternative state.

FIGS. 3-5 generally depict one embodiment of the spray nozzle assembly 12 described in FIG. 1. The spray nozzle 14 of the present embodiment is a rotating or rotary-type nozzle, which is generally cup-shaped and includes an exit orifice 34 on an upper surface 36 thereof. In other embodiments there may be more than one exit orifice. As seen best in FIG. 3, the spray nozzle 14 is substantially square-shaped when viewed from the top of the spray nozzle assembly 12 and includes first, second, third, and fourth sidewall portions 38, 40, 42, 44, respectively. The first, second, third, and fourth sidewall portions 38-44 provide communication elements that indicate various operational states of the spray nozzle assembly 12. In the current embodiment the walls are shown as blank. Preferably, communication elements such as words, symbols, colors, etc., are provided on the respective walls to assist users in selecting an appropriate operational state. It is preferred that the spray nozzle assembly 12 be capable of emitting fluid in one of at least two operational states. In a non-limiting example, a first operational state includes a spray mode, i.e., a divergent spray, and a second operational state includes a foam mode. In this example, the first sidewall portion 38 indicates the spray mode and the third sidewall portion 42 indicates the foam mode. The second sidewall portion 40 and the fourth sidewall portion 44 indicate an off mode where no liquid 20 is allowed to exit through the exit orifice 34. Any combination of operational states is contemplated herein. Further, there could be three operational states, e.g., spray, foam, and stream, as well as one off mode for the four sided spray nozzle 14. In other embodiments, the spray nozzle 14 may be any shape, have more or less than four sidewall portions, and have any number of different operational states and modes.

Figure 10A:
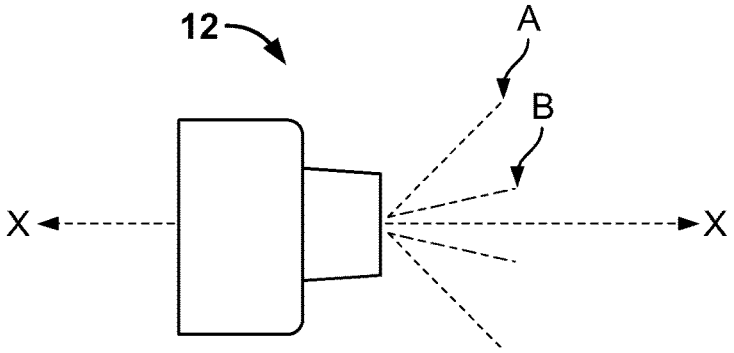
FIG. 10A is a schematic view of several exemplary divergent spray patterns.
Figure 10B:
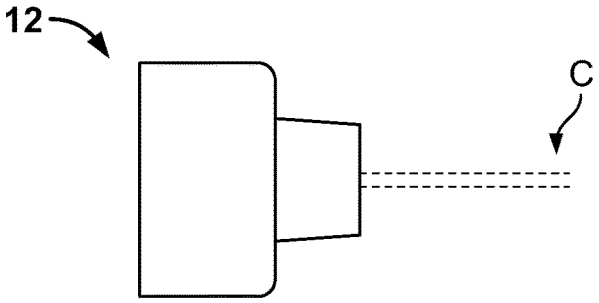
FIG. 10B (Prior Art)
FIG. 10B is a schematic diagram of a prior art stream spray pattern.

When the spray nozzle assembly 12 is in the stream mode, liquid particles are dispensed from the spray nozzle assembly 12 in a single jet like path C (see FIG. 10B). Liquid particles in the jet like path are entrained and travel together at a high momentum following a shared trajectory. When the path C contacts a target surface, the covered area is focused and narrow. When the spray nozzle assembly 12 is in the spray mode, liquid particles exit the spray nozzle assembly 12 along various trajectories relative to one another. As seen in FIG. 10A, a side view of the spray pattern A and B resembles a V-shape. When the spray contacts the target surface, the covered area may resemble a circular or square pattern with a widest dimension of preferably about 1 to about 12 inches.

With reference again to FIGS. 3-5, the cap 16 includes an upper surface 46 and a lower surface 48. The upper surface 46 of the cap 16 has an indicator 50, which, in this embodiment, is in the shape of a triangle. When the spray nozzle assembly 12 is assembled, the indicator 50 points to the sidewall portion of the spray nozzle 14 that corresponds to the mode or spray pattern that will exit the spray nozzle 14. In the present embodiment, the upper surface 46 of the cap 16 also includes an aperture 52. The aperture 52, as seen in FIG. 3, is generally circular and is adapted to receive the spray nozzle 14. In other embodiments, the upper surface 46 of the cap 16 does not include an aperture and the spray nozzle 14 rests directly on the upper surface 46.

Turning to FIG. 4A, the cap 16 of the spray nozzle assembly 12 includes an interior surface 54 that has a threaded portion 56. The threaded portion 56 of the cap 16 is adapted to be screwed onto the container 18. It is also envisioned that other means, such as staking, press fitting, weld fitting, etc., known to those of ordinary skill in the art can be used to attach the spray nozzle assembly 12 to the container 18, such as the squeeze bottle shown in FIG. 2. It is also contemplated that the spray nozzle assembly 12 may be integral with the container 18.

Still referring to FIG. 4A, the spray nozzle assembly 12 of the present embodiment includes five components: the spray nozzle 14, the cap 16, a barrel 58, an o-ring 60, and a dip tube adapter 62. The barrel 58 is received in the aperture 52 of the cap 16 and a lower portion 64 of the barrel 58 enters into a channel 66 of the cap 16. A generally cylindrical upper portion 68 of the barrel 58 protrudes upwardly out of the aperture 52. The dip tube adapter 62 generally has three portions: an upper portion 70, a medial flat portion 72, and a lower portion 74. Theo-ring 60 fits over the upper portion 70 of the dip tube adapter 62 and rests on the medial flat portion 72. The upper portion 70 of the dip tube adapter 62 is inserted through the lower portion 64 of the barrel 58 until the top of the o-ring 60 abuts against a lower end of a surface 76 defining the channel 66 of the cap 16. In the present embodiment, the spray nozzle 14 is fitted onto the upper portion 68 of the barrel 58 to result in a fully assembled spray nozzle assembly 12.

Figure 6:
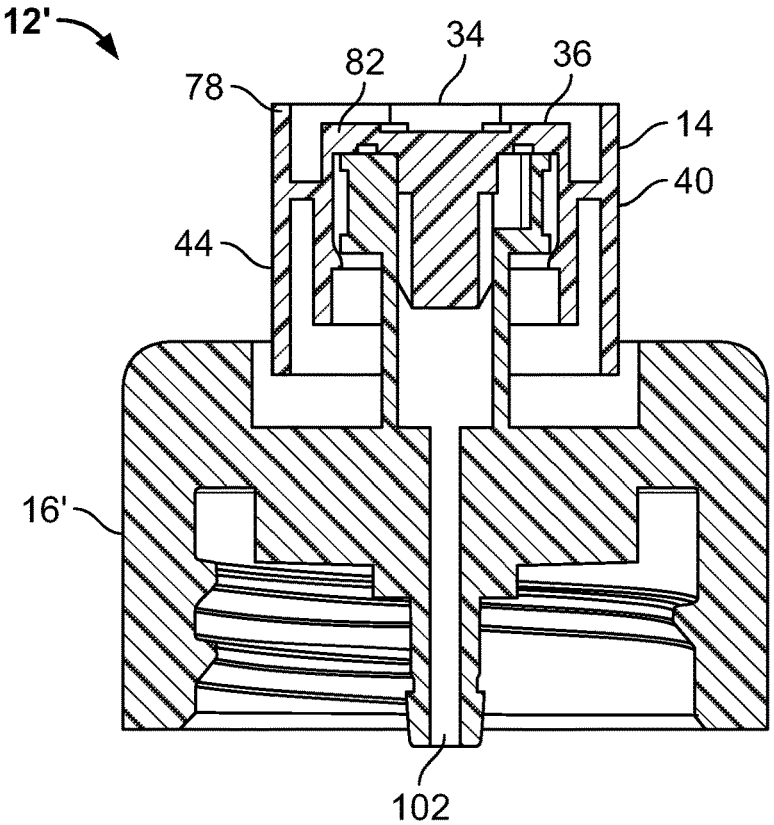
FIG. 6 is an alternative embodiment of the spray nozzle assembly of FIG. 4A.

It is also envisioned that the spray nozzle assembly 12 can be made with integral intermediate parts resulting in a spray nozzle assembly 12' with only two parts: the spray nozzle 14 and an integral cap 16', such as seen in FIG. 6 where like elements are provided with like reference numbers. The integral cap 16' is a custom molded part that performs the same function as the cap 16, the barrel 58, the o-ring 60, and the dip tube adapter 62 from the spray nozzle assembly 12 of FIG. 3. Similarly, the spray nozzle 14 is placed over an upwardly protruding portion of the integral cap 16'.

Turning again to FIGS. 3-5, the spray nozzle 14 of the spray nozzle assembly 12 is shown to include an ON/OFF position and at least one additional spray pattern or mode. The spray nozzle 14 generally comprises a cup-like outer portion 78 defined by the sidewall portions 38-44 and an inner portion 80. The inner portion 80 includes an annular lip 82, which interacts with the barrel 58 to retain the spray nozzle 14 to the cap 16. More specifically, the upper portion 68 of the barrel 58 is provided with a nozzle receiving portion 84 that extends laterally outwardly to form an annular ledge 86 to abut the annular lip 82. The nozzle receiving portion 84 is provided with an opening 88 for receipt of a post 90 of the spray nozzle 14, which are both fashioned to allow for rotation of the post 90 within the opening 88 and, by extension, for rotation of the outer portion 78 of spray nozzle 14 about the barrel 58, the cap 16, and the bottle 18.

In fact, during an in-use state, the spray nozzle 14 is the only structural component that is movable besides the walls of the container 18 while being compressed by a user. More specifically, a user adjusts the spray nozzle between an ON/OFF position prior to spraying of the fluid, which provides for the spray nozzle to be the only dynamic structural component during this pre-operative in-use state. Thereafter, a user sprays fluid through the spray nozzle 14 by squeezing the container 18, which provides for the container 18 to be the only dynamic structural component during an operative spraying in-use state. Further, portions of the barrel 58 that are in fluid communication with the spray nozzle 14 and the container 18 may be generally characterized as a barrel reservoir and are static during all in-use states or conditions.

Turning now to FIG. 4A, the post 90 is shown to include at least two vertical channels 92, which are capable of being placed in fluid communication with a feed channel 94 within the receiving portion 84 when the spray nozzle 14 is aligned properly. In contrast, FIG. 5 depicts the spray nozzle 14 rotatably re-aligned to preclude fluid communication between the channels 92 and 94. In the present embodiment, the spray nozzle 14 is rotated 90 degrees from the position shown in FIG. 4A to block the feed channel 94 and place the vertical channels 92 out of fluid communication therewith so that the spray nozzle 14 is in an off condition where no, or substantially no, liquid 20 is capable of being emitted even if a user squeezes the container 18.

Turning again to FIG. 4A, fluid that enters the feed channel 94 is subsequently placed in fluid communication with an annular channel 96 on an interior surface 98 of the upper surface 36. Thereafter, the fluid is directed into a swirl chamber 100 (see FIG. 5) for imparting a particular spray characteristic, e.g., the swirl chamber 100 geometry may include several bosses (not shown) radially positioned around the exit orifice 34 to impart turbulence to the fluid. Regardless of the particular swirl chamber geometry, the one or more bosses provide channels or feed ducts for directing the fluid toward the exit orifice 34 and subsequently into the atmosphere where the fluid is ejected in a spray pattern, e.g., a divergent spray.

With reference again to FIG. 4A, once the spray nozzle assembly 12 is fully assembled the dip tube 32 is inserted into or around a bottom end 102 of the dip tube adapter 62 and the spray nozzle assembly 12 is then fastened onto the squeeze bottle 18. It is envisioned that the spray nozzle assembly 12 will work with the dip tube 32*b* of FIG. 2B, the dip tube 32*c* of FIG. 2C, and the dip tube 32*d* of FIG. 2D. Once fully assembled, the liquid 20 first enters the dip tube 32 and flows into the dip tube adapter 62 upon the application of a squeezing force or pressure to the bottle 18, which generates a raised internal bottle pressure. Therefore, the greater the user squeeze force, the greater the elevated internal bottle pressure. The generated bottle pressure causes the liquid 20 to flow through the dip tube adapter 62 until it reaches the upper portion 68 of the barrel 58. From the barrel 58, the fluid then enters the two vertical channels 92 located on the post 90, which lead to the feed channel 94. From the feed channel 94 the liquid enters the annular channel 96 prior to entering the swirl chamber 100. Finally, the liquid 20 is ejected from the spray nozzle assembly 12 through the exit orifice 34 in a pattern that corresponds to the predetermined spray pattern mode that the spray nozzle 14 is set to. If the spray nozzle 14 is set to an off position no, or substantially no, fluid will be able to flow through the spray nozzle assembly 12, even if a user squeezes the squeeze bottle 18. It is also contemplated that the spray nozzle assembly 12 can be used without a dip tube 32, as seen in the embodiment of FIG. 2A. In this case, the liquid enters the spray nozzle assembly 12 directly through the bottom end 102 of the dip tube adapter 62 (or other similar aperture leading to the spray nozzle 14) when a user squeezes the squeeze bottle 18. Thereafter, the liquid is ejected from the exit orifice 34 in a similar manner as previously described.

Figure 7:
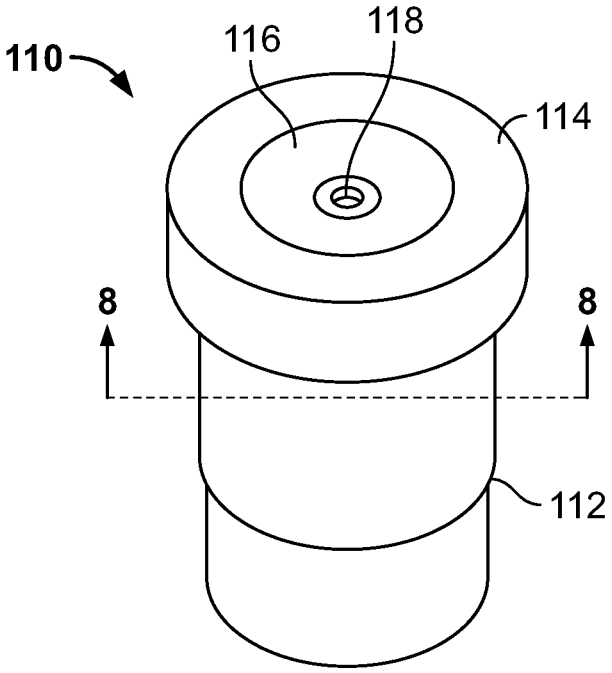
FIG. 7 is an isometric view of a spray insert.
Figure 8:
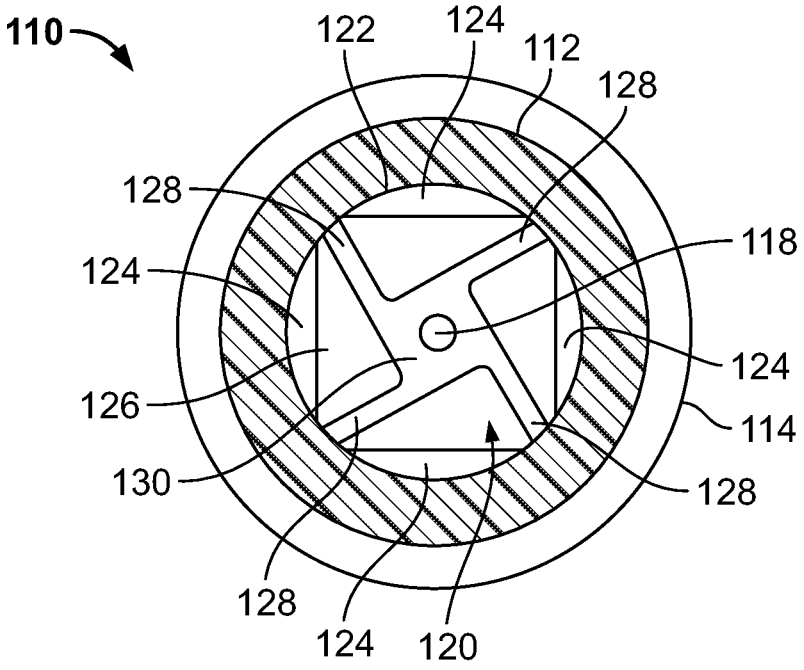
FIG. 8 is a cross-sectional view of the spray insert taken generally along the lines 8-8 of FIG. 7.

Turning now to FIGS. 7 and 8, a spray insert 110 is shown that can be used with the spray nozzle 14 in order to produce a divergent spray pattern in a spray operational state. The spray insert 110 includes a generally cylindrical or stepped cylindrical sidewall 112 having an upper end 114. The upper end 114 includes a conical shaped outer face 116 and an outlet hole 118. As seen in FIG. 8, the cylindrical sidewall 112 defines a bore 120 for receipt of a post (not shown) of the spray nozzle assembly 12. The post may be uniformly cylindrical and have a cross-section smaller than the sidewall 112 and bore 120 to allow for fluid flow through a channel(s) (not shown) defined therebetween or may have some other geometric shape that similarly fits within the bore 120, such as a square, to provide one or more channels for fluid flow. Additionally, the post may be provided with one or more protuberances (not shown) to interact with an inner surface 122 of the sidewall 112 to define one or more fluid flow channels. Further, the inner surface 122 of the sidewall 112 of the present embodiment includes protuberances 124 (see FIG. 8) that interact with the post (not shown) to define one or more fluid flow channels.

With reference again to the spray insert 110 of FIG. 8, an inner surface 126 of the upper end 114 is provided with four feed ducts 128 or channels that are in fluid communication with the one or more channels about the post and sidewall 112, which converge downstream at a swirl chamber 130 of the spray insert 110. In other embodiments there may be more or less than four feed ducts 128 that lead to the swirl chamber 130. The swirl chamber 130 is generally square shaped with the feed ducts 128 extending tangentially therefrom. It is contemplated that the swirl chamber 130 may be any shape such as circular, rectangular, star shaped, or any other shape. It is also anticipated that the feed ducts 128 can extend from the swirl chamber 130 at any angle, not necessarily tangentially from the swirl chamber 130. Further, the outlet hole 118 extends through the upper end 114 to the swirl chamber 130 as a substantially uniformly cylindrical bore; however, it is contemplated that a tapered outlet hole or holes with other geometries may be utilized. The substantially conical continuous spray pattern profile produced from this spray insert 110 can be seen in FIG. 10A. Spray pattern A shows a spray pattern with a spray angle of about 90 degrees, which illustrates that at least 95% of the spray output from the spray insert 110 is bounded by this conical representation taken about an axis X. Alternatively, the spray insert 110 could produce a spray pattern with a smaller spray angle of about 30 degrees shown in FIG. 10A as spray pattern B. When the spray pattern contacts the targeted surface the covered area may be substantially circular, substantially square, or of any other shape. Still further, it is contemplated that numerous spray patterns and emission profiles may be provided that are more advantageous than prior art squeeze bottle emission profiles.

Figure 9:
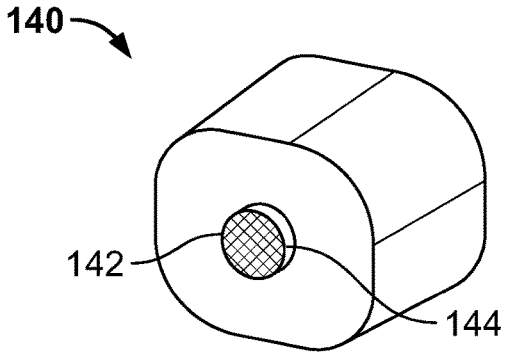
FIG. 9 is an isometric view of another embodiment of a spray nozzle assembly.

With reference to FIG. 9, another type of spray insert is depicted that can be used with the spray nozzle assembly 12 of the present disclosure for producing a foaming spray pattern. Spray insert 140 illustrates a spray insert similar to that of spray insert 110 of FIGS. 7 and 8 with the additional inclusion of a mesh screen 142 provided over an exit orifice 144. During use, once the liquid 20 reaches the exit orifice 144 and comes in contact with the mesh screen 142, a foaming spray pattern is produced when the liquid 20 is agitated by the mesh 142 that is thereafter ejected into the atmosphere.

In another embodiment, the spray nozzle assembly 12 includes an on/off position and a foaming spray pattern. This embodiment could include a fine mesh similar to that of the spray insert 140 of FIG. 9 or some other means for imparting a foaming action. In yet another embodiment, the spray nozzle assembly 12 includes an on/off position and a stream mode. In this embodiment, the annular channel 96 would deliver the liquid 20 to a conventional exit orifice 146 without use of a swirl chamber. In a different embodiment, it is anticipated that the spray nozzle assembly 12 would include an on/off position and at least two other operational states or, alternatively, at least three operational states or, alternatively, four or more operational states. Still further, it is contemplated that the embodiment of FIGS. 3-5 may be modified to exclude multiple operational states and be fashioned with a single spray insert, e.g., the spray insert 110 or 140, for providing a single type of spray characteristic or pattern.

It is anticipated that a user will purchase a squeeze bottle 18 at a store that includes a spray nozzle assembly 12, such as the one shown in FIGS. 3-5. It is also envisioned that a user can pick and choose different caps 16 with different spray nozzles 14 and different spray inserts 110 or 140 to fit to whatever type of container 18 is contemplated for use and to meet the user's anticipated spraying needs. For example, many prior art trigger sprayers dispense their liquid contents in an optimal manner only when they are in an upright position, thereby limiting a user's range of motion and spraying. Also, these prior art trigger sprayers can only dispense their liquid contents in a discrete amount with each pump of the trigger. Further, prior art squeeze bottle sprayers typically only emit fluid as a stream of fluid (see, for example, spray pattern C of FIG. 10B) that limits a user's spray pattern options.

The present disclosure allows a user to gain more functionality than prior art trigger sprayers and prior art squeeze bottle sprayers. Specifically, the spray nozzle assembly 12 can achieve the functionality that prior art squeeze bottle sprayers have with a bottle that can be sprayed in any orientation, e.g., an inverted position, but also achieve a continuous non-stream spray pattern typically only found on trigger sprayers. This functionality may be useful, for example, when a user intends to clean a hard to reach area such as a toilet bowl. In this example, a continuous spray can be used in an inverted position that allows the liquid 20 to be applied directly to the desired location. This would not be possible with prior art trigger and squeeze bottle sprayers.

Also, in many prior art squeeze bottles there is no off spray mode so that once the bottle is turned upside-down the liquid comes out of the exit orifice. This may be useful, for example, when a user intends to spray a stain on a fabric or spray some other surface to be cleaned. In this example, a foaming spray pattern would be useful to allow the liquid 20 to be applied directly to the surface and to penetrate the stain to provide a more effective deodorizing or cleaning function without getting the liquid 20 on an undesired area. The present disclosure illustrates how the spray nozzle assembly 12 may be fashioned with a squeeze bottle to avoid the deficiencies of prior art sprayers.

In the case where the user purchases the spray nozzle assembly 12 separate from the container 18, the following use instructions can be provided to a consumer or user on the packaging for the spray nozzle assembly 12, as an insert within the packaging, or on the spray nozzle assembly 12 itself. First, a user is instructed to attach the spray nozzle assembly 12, as seen in FIG. 4A, onto the squeeze bottle 18 (see FIG. 2) by threading the cap 16 onto the squeeze bottle. Thereafter, the user is instructed to rotate the spray nozzle 14 until the sidewall portion with the desired spray pattern is adjacent to the indicator 50. Once the spray pattern is selected, the user is instructed to orient the squeeze bottle to a position directed at the intended surface or area to be sprayed and then apply a pressure to the squeeze bottle 18. Alternatively, if the spray nozzle assembly 12 is already secured onto or otherwise integrally fashioned with a container 18, the first step may be omitted and the use instructions can be provided as noted above.

The exemplary embodiments disclosed herein are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention.

Other embodiments of the disclosure including all the possible different and various combinations of the individual features of each of the foregoing described embodiments and examples are specifically included herein.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications that come within the scope of the appended claims are reserved.

We claim:

1. A spray nozzle assembly, comprising:

a squeeze bottle;

a spray nozzle;

a cap attached to the squeeze bottle, the cap having an aperture that receives the spray nozzle;

a barrel extending from the cap and into the spray nozzle;

a dip tube adapter; and a dip tube, wherein the dip tube is connected to a bottom end of the dip tube adapter and an upper portion of the dip tube adapter is inserted through a lower portion of the barrel, and wherein the spray nozzle is rotatable about the cap and the barrel, and includes a first operational state and a second operational state for the emission of fluid.

2. The spray nozzle assembly of claim 1, wherein the first operational state is an off state and the second operational state is a spray state.

3. The spray nozzle assembly of claim 2, wherein the spray state is a foaming spray state.

4. The spray nozzle assembly of claim 2, wherein the spray state is a stream spray state.

5. The spray nozzle assembly of claim 1 further comprising a third operational state wherein the first operational state is an off state, the second operational state is a spray state and the third operational state is a stream state.

6. The spray nozzle assembly of claim 1 further comprising one or more communication elements disposed on one or more walls of the spray nozzle.

7. The spray nozzle assembly of claim 1, wherein the dip tube is in fluid communication with the spray nozzle.

8. The spray nozzle assembly of claim 7, wherein the dip tube is molded to an interior surface of the squeeze bottle.

9. The spray nozzle assembly of claim 1, wherein the squeeze bottle is formed from one of high-density polyethylene, polypropylene, or polyethylene terephthalate.

* * * * *